United States Patent [19]

Mahn

[11] 4,089,730

[45] May 16, 1978

[54] AISLE MARKER APPLICATING MACHINE

[75] Inventor: Günther Hans Mahn, Brookfield, Wis.

[73] Assignee: W. H. Brady Co., Milwaukee, Wis.

[21] Appl. No.: 786,539

[22] Filed: Apr. 11, 1977

[51] Int. Cl.[2] ..... B44C 1/10; B44C 7/06

[52] U.S. Cl. ..... 156/541; 156/577; 156/584

[58] Field of Search ..... 156/577, 584, 579, 536, 156/540–542

[56] References Cited

U.S. PATENT DOCUMENTS

| | | | |
|---|---|---|---|
| 2,317,576 | 4/1943 | Avery | 156/584 |
| 3,453,660 | 7/1969 | Gehweiler et al. | 156/378 |
| 3,463,694 | 8/1969 | De Roshia | 156/577 |
| 3,522,136 | 7/1970 | Williams et al. | 156/584 |
| 3,551,262 | 12/1970 | Kelly | 156/584 |

*Primary Examiner*—Douglas J. Drummond
*Attorney, Agent, or Firm*—Quarles & Brady

[57] ABSTRACT

A machine for applying marker labels carried on a liner web onto a floor surface in order to mark aisles or other boundaries on the floor, in which the liner web is driven intermittently so that markers closely spaced thereon are applied to the floor at a greater spacing, which machine incorporates a simplified driving mechanism based around a pivotal foot lever which is conveniently actuated for engagement and disengagement of the drive means which transports the liner through the machine and which also optionally may include a stripper member having a curved edge about which the liner travels for improved dispensing of the labels from the liner.

6 Claims, 10 Drawing Figures

AISLE MARKER APPLICATING MACHINE

BACKGROUND OF THE INVENTION

The present invention relates to applicator machines of the type designed to dispense pressure sensitive adhesive labels carried closely spaced to one another on a release liner and apply them to a floor for boundary marking.

U.S. Pat. No. 3,453,660 discloses a marker applier machine within the field of the present invention. The machine of the patent is a relatively complex machine designed to remove markers from a liner strip and apply them at desired intervals along a floor upon movement of the machine across the floor. The machine of the patent also provides for applying the markers individually at random intervals or automatically at various preset intervals. Machines of the type covered by the patent have been sold commercially for a number of years and have provided satisfactory service for many users.

The present invention provides a floor marker applicator which performs much the same function as the machine of U.S. Pat. No. 3,453,660 but incorporates a simplified mechanical structure through the provision of a foot lever which is actuated by the operator of the machine to control transport of the markers through the machine. Additionally, the present invention provides a simplified housing structure for the support of the various functional mechanical elements, and provides a stripping member of improved function.

SUMMARY OF THE PRESENT INVENTION

My present invention provides a floor marker applicating machine of the type which carries a roll of liner material on which markers are releasably joined and transports the liner through the machine in intermittent fashion to provide for spaced dispensing of the markers onto a floor, characterized as incorporating one or more of the following improvements: (1) a foot lever adapted for limited pivotal movement to provide for intermittent transport of the liner web through the machine when it is desired to dispense labels therefrom and to disengage drive elements when it is desired to move the machine without transporting the web through it, (2) a simple housing for supporting the shafts and associated functional mechanisms, and (3) a stripper edge about which the liner web moves that is curved transversely of the web in order to provide for effective dispensing of markers therefrom and to aid in centering the liner during its movement.

The principal object of my invention was to develop a floor marker applicator machine of simplified structure to enable economical construction, and thereby extend the use of the machine, and a rugged machine capable of extended use in factories, shops and similar environments. A more limited objective was to provide the particular details of structure or function as set forth in the claims which follow.

DESCRIPTION OF THE PREFERRED EMBODIMENT(S)

Figures 1, 2:
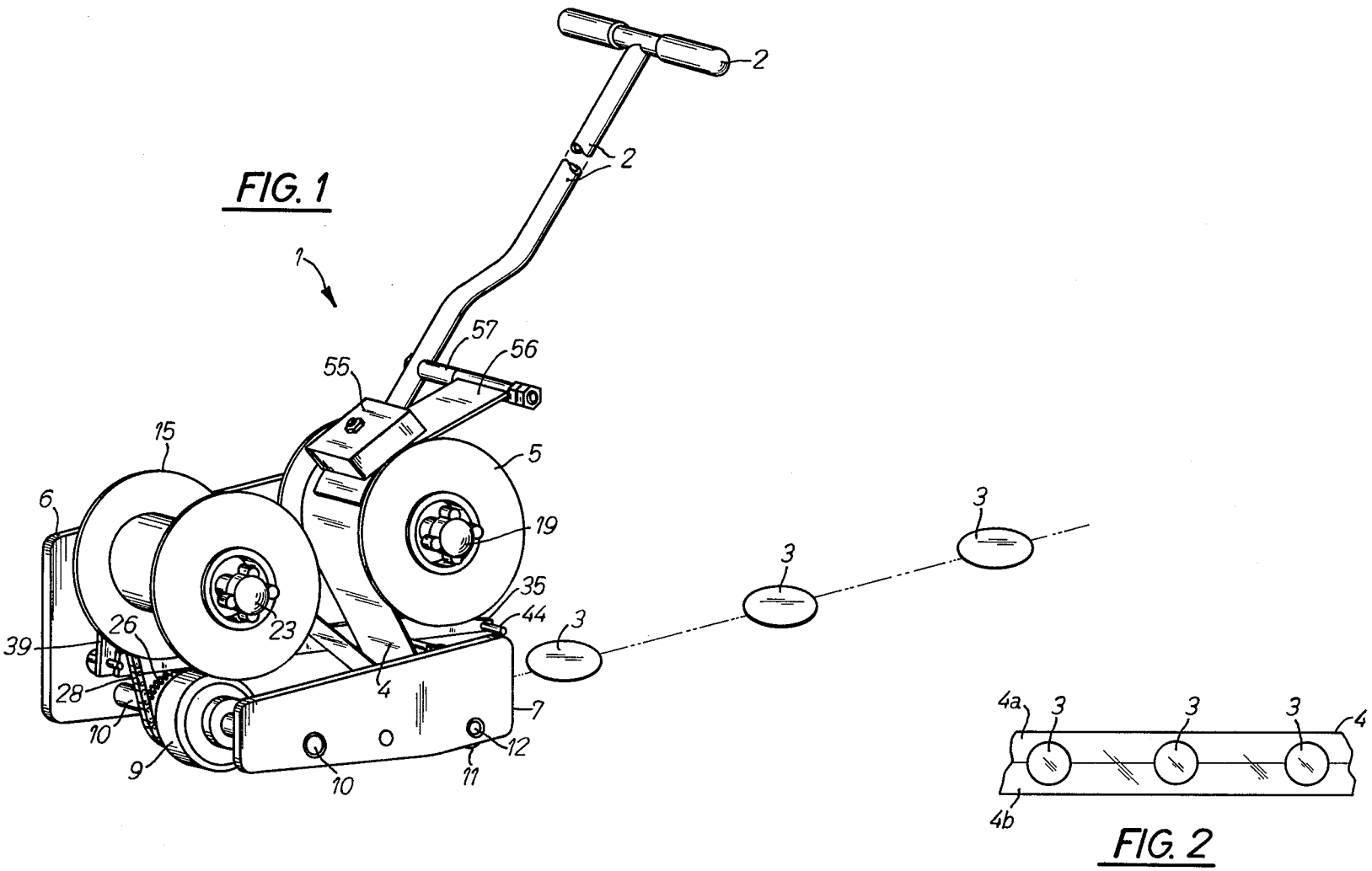
FIG. 1 is a perspective view of a floor marker applicating machine according to the present invention shown as it is being moved to apply markers to a floor surface.
FIG. 2 is a view of a portion of liner web carrying the pressure sensitive adhesive markers which are dispensed by the machine.

FIG. 1 illustrates a floor marker applicating machine 1 constructed according to the present invention as it would be used in its normal operation of applying markers along a floor. The machine 1 is designed to be pushed along a floor by a handle 2 and cause markers 3 to be removed from a liner web 4 and applied to the floor. As illustrated in FIG. 2, the liner 4 is an elongate web of release material or release coated material and the markers 3 are closely spaced along the liner. The liner itself may be split into sections **4*a* and 4*b* along a longitudinal slit line. The markers 3 have a layer of pressure sensitive adhesive by which they are releasably attached to the liner. The markers are closely spaced to one another on the liner, and the machine 1 is designed to remove the markers 3 from the liner 4 and apply them to a floor at a preselected distance between each marker which is greater than the space between the markers when carried on the web. Thus in an exemplary case, markers about 3 inches in diameter are spaced about $3\frac{1}{4}$ inches between centers along the web 4, and the machine 1** may be designed to apply the markers to a floor at a distance of about $12\frac{1}{2}$ inches between the centers of adjacent markers.

The machine 1 includes a vertical rear or main wall 6 and a smaller vertical front wall 7 spaced from one another and connected together by means of a spacer shaft 8 (see FIG. 3) fixed in place between the two walls. The two walls thus provide a simple housing capable of supporting the machine elements and economical to manufacture. The machine moves along a floor on a front wheel 9 attached to a shaft 10 journaled between walls 6 and 7 and a rear roller 11 carried on a shaft 12 also journaled between the walls 6 and 7.

Figure 4:
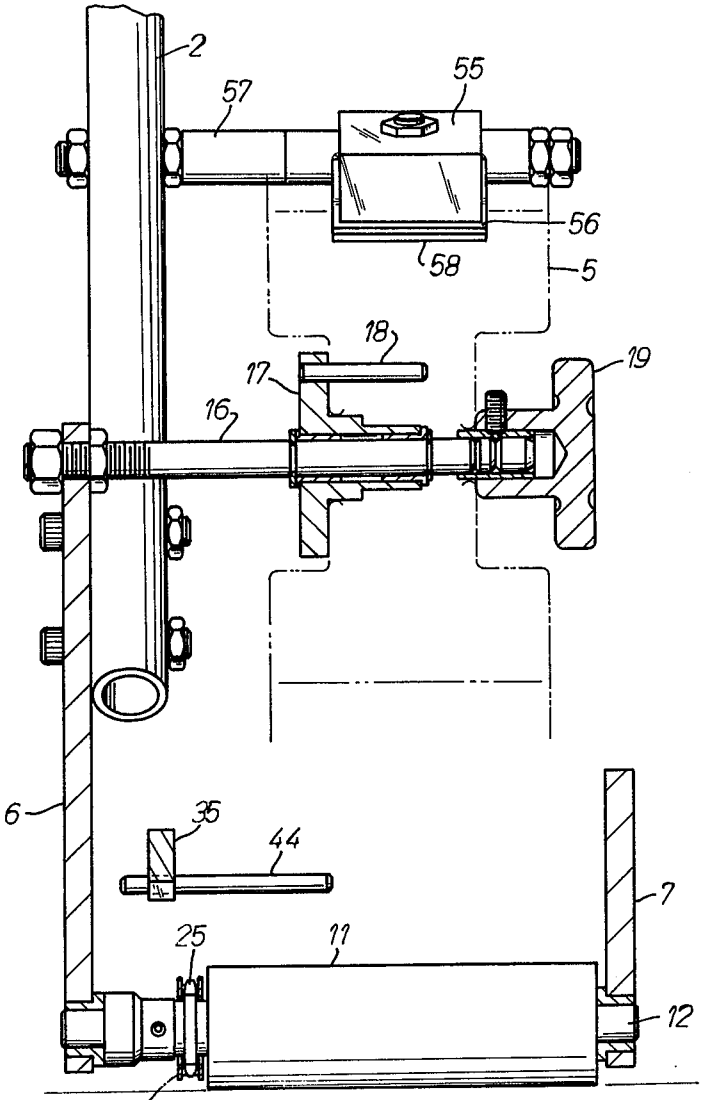
FIG. 4 is a vertical sectional view of the machine taken along the plane of line 4—4 in FIG. 3.
Figure 5:
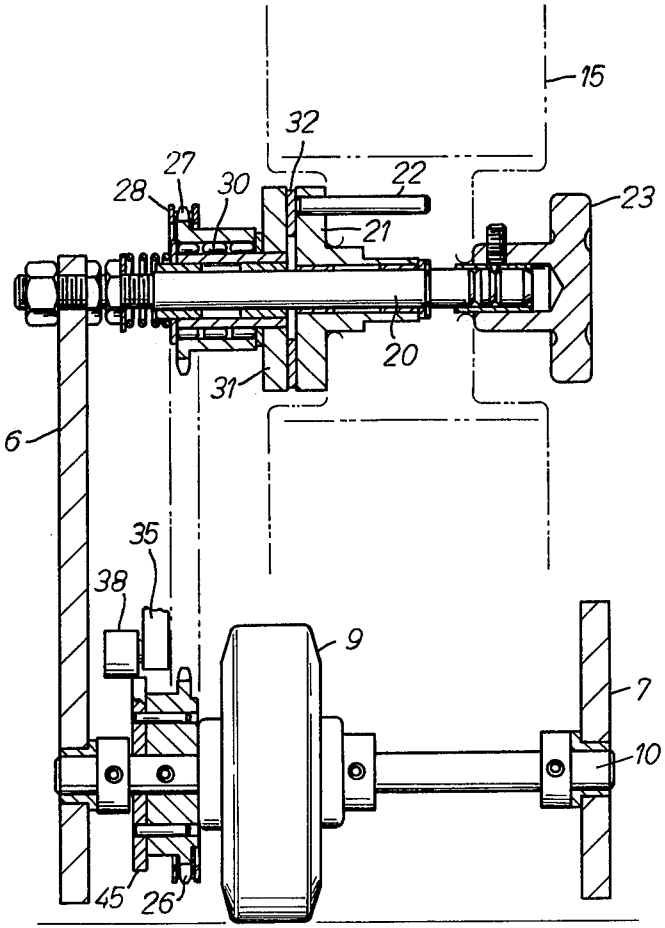
FIG. 5 is a vertical sectional view of the machine taken along the plane of line 5—5 of FIG. 3.

As indicated in FIG. 1 the liner 4 which initially carries the markers 3 is wound into roll form and carried on a supply reel 5 from which it is threaded through the machine onto a take-up reel 15. Turning now to FIG. 4, a shaft 16 is fixed to and cantilevered from the wall 6 of the machine, and an arbor 17 is rotatably mounted about the shaft 16. The supply reel 5 is carried on the arbor 17, the arbor including a pin 18 that extends into the hub of the reel to provide a driving connection between the two. The supply reel is fastened into place by means of retaining knob 19 attached to the end of the shaft 16. Turning next to FIG. 5, shaft 20 is fixed to and cantilevered from the wall 6 near the front edge thereof, and an arbor 21 is rotatably mounted on the shaft 20. The take-up reel 15 is carried on the arbor 21, for rotation therewith, and held in place by means of a pin 22 extending from the arbor. The take-up reel is held on the shaft 20 by the retaining knob 23 attached to the end of the shaft. Supply and take-up reels or arbors of constructions other than those specifically illustrated may be employed with the machine of this invention.

As shown in FIG. 4, a chain sprocket 25 is attached near one end of the shaft 12. As shown in FIG. 5, a chain sprocket 26 is attached near one end of the shaft 10, and a sprocket 27 is attached near one end of the shaft 20. A chain 28 is trained about the sprockets 25, 26 and 27, most clearly illustrated in FIG. 3, in order to rotate the shafts 10 and 20 as described below when the machine is rolled along the ground on the wheel 9 and roller 11.

An overrunning clutch 30 is pressed into sprocket 27 (see FIG. 5) and rotates about the hub of flange 31. The flange 31 carries a disc 32 of friction material (such as brake lining) which contacts the arbor 21 to rotate it. When the machine is pushed in its normal working direction (to the left in FIG. 1), sprocket 27 rotates clockwise and the arbor 21 is driven through the clutch 30. The drive mechanism is preferably designed to rotate faster than the arbor 21 so as to maintain tension in the liner 4 between the supply and take-up rolls. When the machine is moved in the opposite direction (to the right in FIG. 1) sprocket 27 will rotate clockwise but flange 31 and arbor 21 will remain stationary due to the action of the clutch 30.

Figure 3:
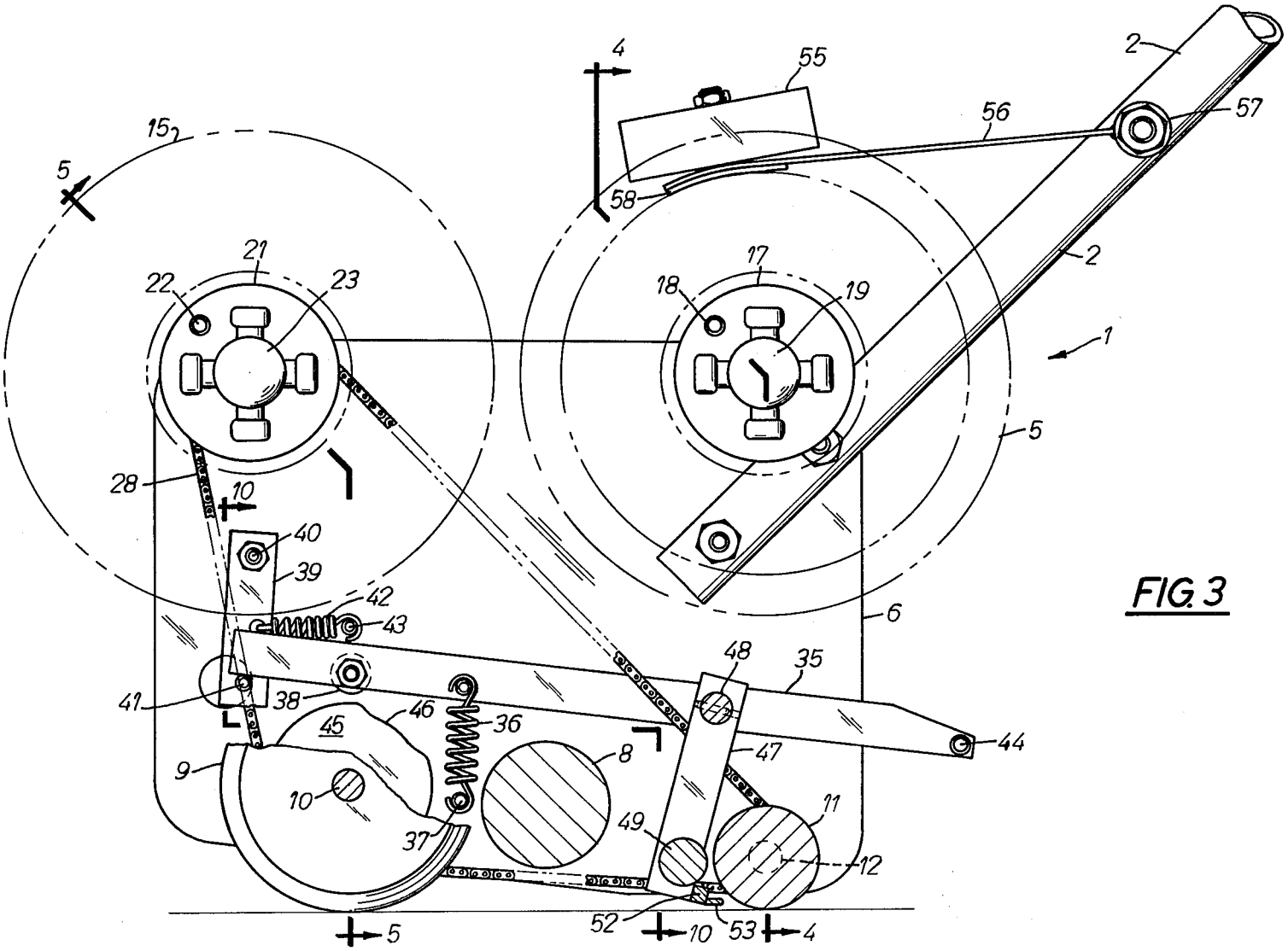
FIG. 3 is a side view of the machine, partly in section, with portions broken away.

Referring now to FIG. 3, a foot lever 35 is supported on shaft 48 journaled between walls 6 and 7 of the machine. A spring 36 is connected between a bolt located near the central portion of the foot lever 35 and a pin 37 attached to the wall 6. A rotatable cam follower 38 is attached to the foot lever 35 near its front end. (See also FIG. 5.) An operating lever 39 is pivotally attached at 40 to the wall 6 of the machine, positioned near the front end of the foot lever 35. The lower end of the operating lever 39 includes a pin 41 that projects through an aperture in the wall 6, best shown in FIG. 9. The pin 41 also extends in the opposite direction from the wall 6 so as to engage the bottom of the foot lever 35 to hold the foot lever in the position shown in FIG. 3 wherein the drive elements for transporting the liner 4 through the machine are disengaged so that the liner is not moved. A spring 42 is connected between a central part of the operating lever 39 at its one end and a pin 43 attached to the wall 6. A short toe shaft 44 is attached to the rear end of the foot lever, which, as best indicated in FIG. 1, is positioned at the rear of the machine 1.

Returning to FIG. 3, a cam 45 is attached to the shaft 10 which carries the front wheel so as to rotate upon rotation of the shaft. The cam 45 includes a land portion 46 for the purpose hereinafter described. The cam follower 38 is arranged to ride along the cam 45 when the machine is in its marker application function.

Figure 8:
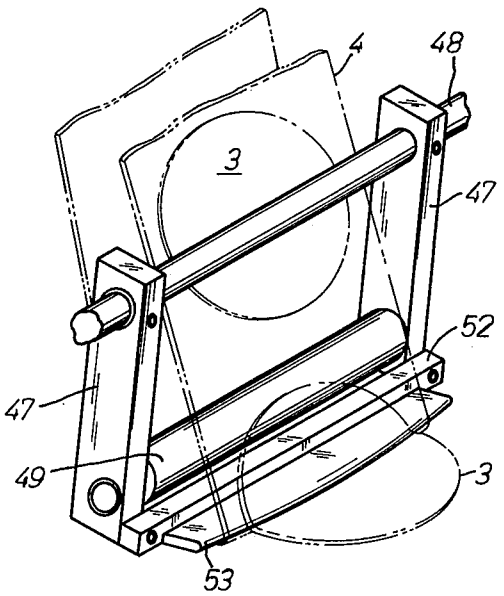
FIG. 8 is a rear perspective view of one portion of the machine.
Figure 9:
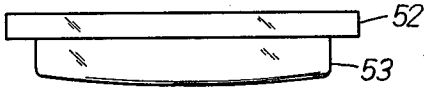
FIG. 9 is a view of the curved stripper edge incorporated in the machine.
Figure 10:
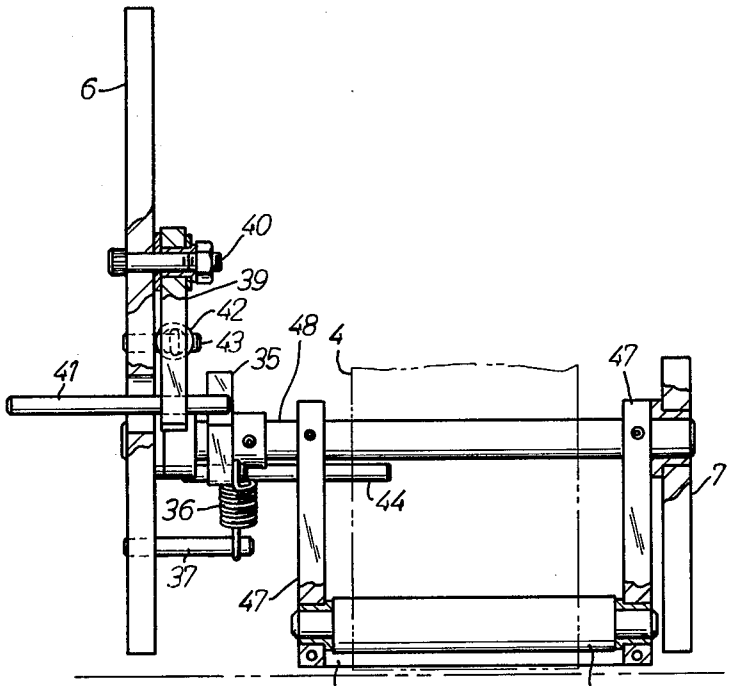
FIG. 10 is a vertical sectional view taken along the plane 10—10 of FIG. 3.

Considering now FIGS. 3, 8 and 10, a pair of spaced arms 47 are attached to shaft 48. The arms 47 support a roller 49 between their lower ends. Turning now to FIG. 8, a stripper member 52 is also attached across the lower ends of the arms 47 and includes a rearwardly facing stripping edge 53. As illustrated in FIG. 9, the stripping edge 53 is curved transversely of the liner and the liner 4 will be trained about the curved stripping edge when positioned as in FIG. 8. The curved stripping edge has been found to provide for efficient removal of the markers from the liner and also help in centering the liner in its desired position in the machine.

As shown in FIG. 8, the markers 3 are releasably joined to the liner 4 so that they become detached from the liner upon passing about the stripping edge without adverse delamination of adhesive so that the markers will become adhered to the floor.

Referring to FIGS. 1 and 3, a brake is supported from the handle 2 of the machine so as to bear against the liner 4 on the supply roll. The specific brake element illustrated includes a weight 55 carried on arm 56 rotatably supported from a shaft 57 attached to the handle. The underside of the arm 56 carries a frictional pad 58 which bears against the liner. Tension is applied to the liner 4 between the supply reel 5 and the take-up reel 15 by the action of the brake and the drive mechanism for the clutch 30; the tension is high enough to obtain proper dispensing of markers from the liner over the range of a fully loaded supply reel to an empty reel.

OPERATION

The operating lever 39 is shown in its disengaged position in FIG. 3 wherein it is arranged such that the pin 41 projecting from its lower end is positioned underneath the front end of the foot lever 35. In this position, the foot lever is raised sufficiently that the cam follower 38 is out of engagement with the cam 45. With the mechanism in this position, the operator can attach a supply roll of the markers onto the shaft 16 and thread the liner downwardly between the stripper member 52 and the roller 11, and then upwardly about the roller 49 and attach the end of the web 4 to the take-up reel 15 carried on the shaft 20. With the material thusly in place, and the operating lever 39 in the position shown in FIG. 3, the machine 1 can be transported about the floor without any of the web being fed through the machine. This allows the operator to transport the machine to a specific work area without dispensing markers from the web.

Figure 6:
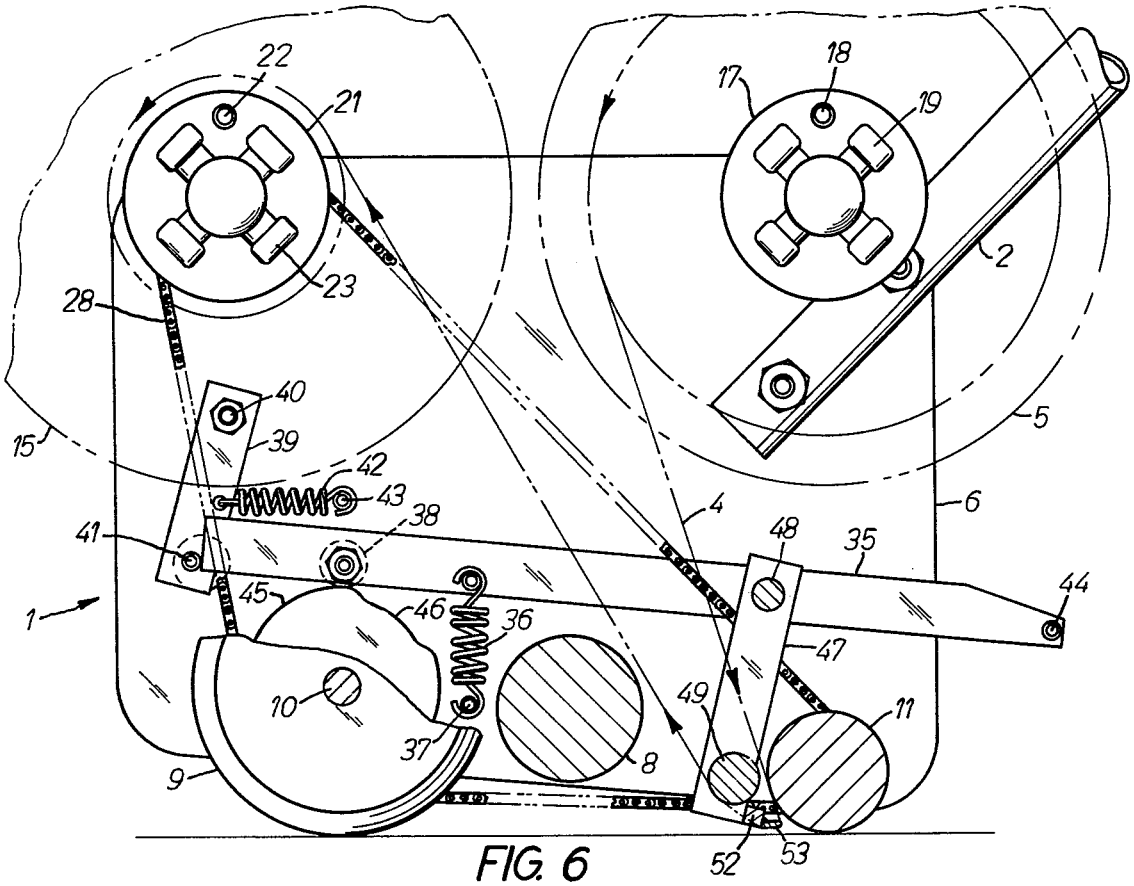
FIG. 6 is a side view of the machine, partly in section, showing the driving mechanism in one phase of its operation.
Figure 7:
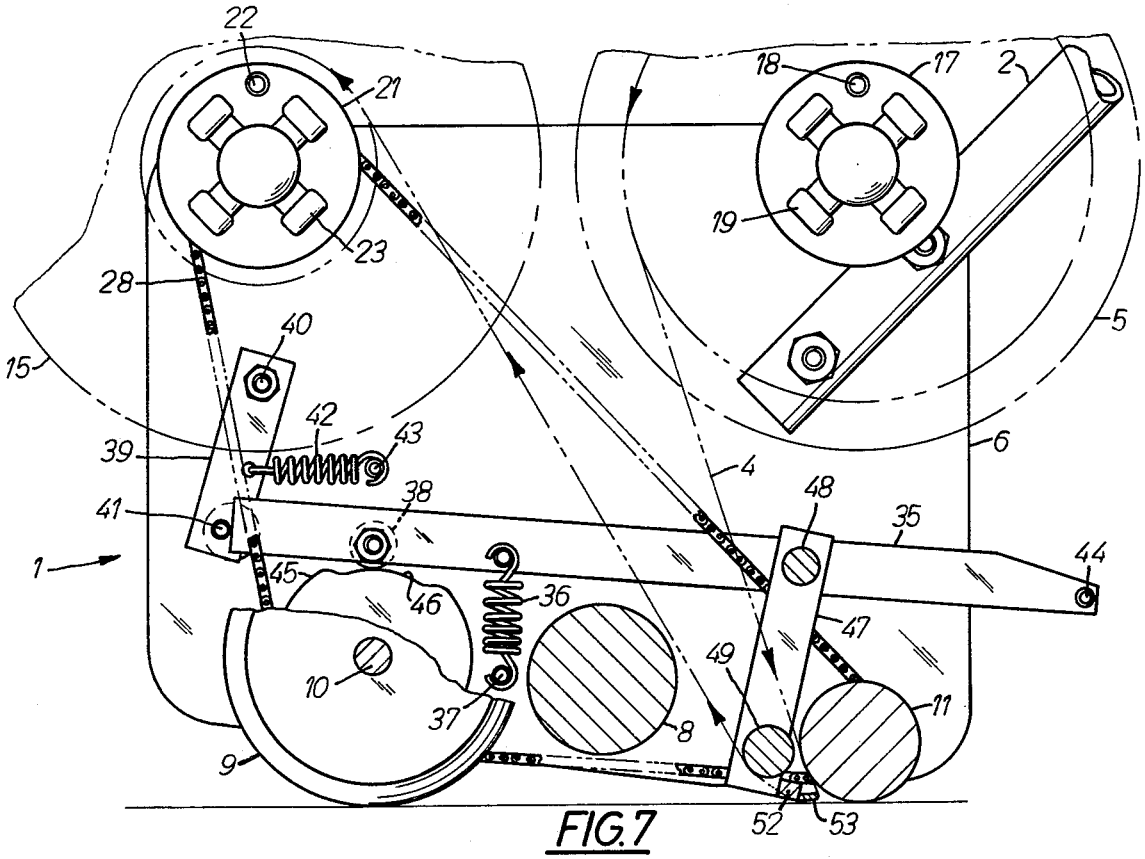
FIG. 7 is a view similar to FIG. 6 showing the mechanism in another phase of its operation.

When the operator is ready to dispense the markers along a line or other guide, the operating lever 39 is rotated forwardly by pushing that part of pin 41 which extends outside of the wall 6, using either hand or foot. This movement of the operating lever 39 allows the foot lever to pivot, and the foot lever rotates couterclockwise to the position shown in FIG. 6 so that the cam follower 38 supported on the foot lever 35 will engage the edge of the cam 45. As the machine 1 is pushed along the floor, the cam 45 rotates along with rotation of the wheel, and the follower 38 will travel along the outer periphery of the cam. In this condition, the liner 4 remains stationary and is not fed through the machine. When the land 46 of the cam is reached, see FIG. 7, the cam follower 38 moves down and across the land and the foot lever 35 will pivot slightly in counterclockwise direction to the position shown in FIG. 7. This movement of the foot lever causes the shaft 48 to rotate a slight amount and thereby rotate the arms 47 to bring the roller 49 to bear against the roller 11. The liner 4 is gripped between the two rollers and withdrawn off the supply roll and transported in the direction of the arrows in FIG. 7 to the take-up reel 15. As the web 4 is thusly transported from one reel to the other, the liner travels about the stripper edge 53, see now FIG. 8, and a marker 3 will be dispensed from the liner and onto the floor which is to be marked. After one marker has been completely removed from the liner and applied where desired, continued movement of the machine will cause the cam 45 to rotate and when the cam follower 38 on the foot lever has completed its motion across the land of the cam to again reach its outer periphery, the foot lever will pivot slightly in a clockwise direction, whereupon the shaft 48 will pivot in the same direction to remove the driving engagement between the rollers 49 and 11 and thereby cease transport of the liner 4 from the supply reel to the take-up reel. The liner will remain stationary until the next time the cam follower reaches the land area of the cam. As can be seen from the above description, the machine is easily operated, due mainly to the simplified structure based around the use of the foot lever for controlling engagement and disengagement of the liner driving mechanism.

I claim:

1. In a floor marker applicating machine of the type adapted to transport a liner carrying closely spaced pressure sensitive adhesive markers from a supply roll thereof to a take-up reel and including (a) a housing, (b) rotatable elements on which the machine is moved along a floor, and (c) drive means driven by one of the rotatable elements and adapted for intermittent transport of the liner from the supply reel to the take-up reel, during which transport a marker is dispensed from the liner onto a floor surface when the liner passes about a stripper edge positioned between the two reels, the improvement wherein:

(1) a foot lever is attached to a shaft pivotally mounted in the housing and includes a portion extending beyond the rear of the machine, (2) a first element of the drive means is associated with a shaft rotated upon movement of the machine and a second element of the drive means is carried on the foot lever; and (3) the foot lever is pivotable between a first position wherein the first drive element and second drive element are interconnected for intermittent transport of the liner through the machine and a second position in which the first and second drive elements are disconnected from one another so that the liner remains stationary upon movement of the machine.

2. Apparatus according to claim 1, wherein:

the second drive element of the drive means includes a roller carried on the shaft to which the foot lever is attached, and the roller engages the liner between it and a rotatable element of the machine for transport of the liner when the foot lever is in its first position.

3. Apparatus according to claim 1, wherein:

the stripper edge about which the liner travels is curved transversely of the liner.

4. Apparatus according to claim 1, wherein:

the housing of the machine consists of a vertical main wall and a vertical second wall spaced therefrom, the take-up and supply reels are carried on shafts cantilevered from the main wall, the rotatable elements are carried on shafts journaled between the two walls, and the foot lever is carried on a shaft pivoted between the two walls.

5. Apparatus according to claim 2, wherein:

the first drive element of the drive means includes a cam rotated upon rotation of one of the rotatable elements of the machine and a cam follower carried on the foot lever, the cam having a land portion along its periphery wherein the cam follower engages the periphery of the cam when the foot lever is in its first position and the liner is transported when the cam follower crosses the land portion of the cam.

6. Apparatus according to claim 1, wherein:

a pivotable operating lever is supported on the housing that engages the foot lever to hold it in its second position and is pivotable to another position in which the foot lever moves to its first position for intermittent transport of the liner through the machine.

* * * * *